United States Patent [19]

Kishishita

[11] Patent Number: 4,874,173

[45] Date of Patent: Oct. 17, 1989

[54] SLOT MACHINE

[76] Inventor: Ryutaro Kishishita, 109 Yamatecho, Naka-ku, Yokohama, Kanagawa, Japan

[21] Appl. No.: 189,328

[22] Filed: May 2, 1988

[30] Foreign Application Priority Data

Dec. 11, 1987 [JP] Japan ..... 62-187803[U]
Dec. 25, 1987 [JP] Japan ..... 62-327427
Feb. 18, 1988 [JP] Japan ..... 63-34069

[51] Int. Cl.[4] ..... A63F 5/04
[52] U.S. Cl. ..... 273/143 R; 40/475
[58] Field of Search ..... 273/143 R, 143 B, 143 C, 273/143 D, 143 E; 40/475

[56] References Cited

U.S. PATENT DOCUMENTS 4,695,053 9/1987 Vazquez, Jr. et al. ..... 273/143 R
4,718,672 1/1988 Okada ..... 273/143 R
4,722,527 2/1988 Gauselmann ..... 273/143 R
4,773,647 9/1988 Okada et al. ..... 273/143 R

FOREIGN PATENT DOCUMENTS

WO/8605407 9/1986 PCT Int'l Appl. ..... 273/143 R
2130413 5/1984 United Kingdom ..... 273/143 B

*Primary Examiner*—Anton O. Oechsle
*Attorney, Agent, or Firm*—Rogers & Killeen

[57] ABSTRACT

A slot machine has a wheel mechanism including a plurality of motors, a plurality of rotary shafts rotated about their respective axes by the driving forces of the motors, and symbol carrying members each having a relatively small radius of gyration and carrying a symbol on its visible surface. The symbol carrying members are spaced apart at equal interals in at least three horizontal rows and at least three vertical columns. Accordingly, the depth of the casing frame of the slot machine can be reduced to a remarkable extent, and a player can immediately identify the winning line visually.

4 Claims, 6 Drawing Sheets

PRIOR ART

SLOT MACHINE

BACKGROUND OF THE INVENTION

1. Field of the Invention

The present invention relates to an improved wheel mechanism for use in a slot machine.

2. Description of the Related Art

In general, slot machines include three wheels each having an outer circumferential surface which carries a plurality of symbols such as fruit, the three wheels being disposed in side-by-side relationship for independent rotation about a common axis. The wheels are spun by a player, and he can win predetermined prizes according to given combinations of the symbols visible when the wheels stop rotating.

However, such a conventional type of slot machine commonly has a plurality of wheels each having an outer circumferential surface which carries at least about twenty-one symbols of objects such as fruit. For this reason, each of the wheels is formed to have a diameter of about 20 cm.

Accordingly, the above-described conventional type of slot machine requires a casing frame having a depth that will allow accommodation of such 20 cm dia. wheels, since the casing frame defines the external configuration of the machine. A problem with this conventional construction is that the casing frame is required to have a substantial depth.

One method of enhancing the amusement value of a game is to increase the number of symbols illustrated on each wheel and hence the number of winning combinations of symbols, namely, the number of prize lines. In order to increase the number of symbols, however, the outer diameter of each of the wheels must be further enlarged, given that the size of each of the symbols is equal. As the wheel diameter increases, the casing frame of the machine which accommodates the wheels needs to be enlarged. It is, therefore, obvious that this is not a suitable method for commercial applications.

A conventional type of wheel mechanism is arranged to inform a player that he has won a prize by the flash of indicator lamps or the generation of a sound indicative of the winning of the prize whatever the winning combination of symbols may have been. Therefore, in order to understand what the winning combination was, the player must visually confirm the symbols on the wheels along each of the prize lines.

However, the need for visual confirmation of the symbols on each of the prize lines upon the winning of each prize distracts the attention of the player from the game. Therefore, if the player continues playing the slot machine for some time, he may experience fatigue during or after the game.

SUMMARY OF THE INVENTION

It is, therefore, a first object of the present invention to provide an improved wheel mechanism for use in a slot machine in which the outer diameter of each wheel or an equivalent member serving as a symbol carrying means (hereinafter referred to simply as a "wheel") is made much smaller than the outer diameter of the wheels used in a conventional type of slot machine so that the radius of gyration of each wheel may be diminished to allow for a reduction in the overall depth of the slot machine.

It is a second object of the present invention to provide an improved wheel mechanism for use in a slot machine in which, in spite of the reduced diameter of the wheels, the number of symbols illustrated on each wheel can be made equal to or greater than the number of symbols on the wheels of a known slot machine, as well as offering the ability to set prize lines in patterns that have previously been impossible to realize.

It is a third object of the present invention to provide an improved wheel mechanism for use in a slot machine which has a winning display means that, when a player wins a prize, the player can immediately identify a prize line corresponding to the prize even while he is not observing symbols on the wheels with normal attention.

To achieve the first object, the present invention provides a first arrangement characterized by:

a plurality of motors;

a plurality of rotary shafts rotated about their respective axes by the driving forces of the motors; and symbol carrying means each having a relatively small radius of gyration and carrying a symbol on its visible surface, the symbol carrying means being spaced apart at equal intervals in at least three horizontal rows and at least three vertical columns.

To achieve the second object, the present invention provides a second arrangement characterized by:

a plurality of motors;

a plurality of rotary shafts rotated about their respective axes by the driving forces of the motors;

symbol carrying means each having a relatively small radius of gyration and carrying a symbol on its visible surface, the symbol carrying means being spaced apart at equal intervals in at least three horizontal rows and at least three vertical columns;

a face panel including display windows which allow for visual confirmation of symbols on the symbol carrying means, the face panel being disposed in front of the symbol carrying means; and at least six prize lines formed on the face panel between adjacent ones of the display windows to respectively link the symbols which are visible in the display windows formed in the face panel.

To achieve the third object, the present invention provides a third arrangement adapted for a slot machine having symbol carrying/changing means such as wheels on which symbols are illustrated, the symbols being changed by causing movement of the symbol carrying/changing means, the third arrangement characterized by: light emitting means disposed along the axis of each of the prize lines, the light emitting means being capable of selectively emitting light along a prize line corresponding to any of winning combinations of the symbols, the prize lines formed on the face panel to link the symbols on adjacent ones of the symbol carrying/changing means.

In accordance with the present invention, the wheels serving as the symbol carrying means are arranged in at least three rows and three columns, whereby the depth of the casing frame of a slot machine can be reduced to a remarkable extent.

Since prize lines can be constituted by a plurality of rows containing at least nine small diameter wheels, at least six prize lines can be set.

Furthermore, the light emitting means provided along each of the prize lines is arranged in such a manner that when a player wins a prize, only the light emitting means represented by the prize line with the winning combination is caused to emit light. Therefore, the player can immediately identify the prize line visually by means of the emitted light.

BRIEF DESCRIPTION OF THE DRAWINGS

The invention will be better understood from the following description taken in conjunction with the accompanying drawings in which.

DESCRIPTION OF THE PREFERRED EMBODIMENTS

The embodiments of the present invention will be described below with reference to the accompanying drawings.

Figure 1:
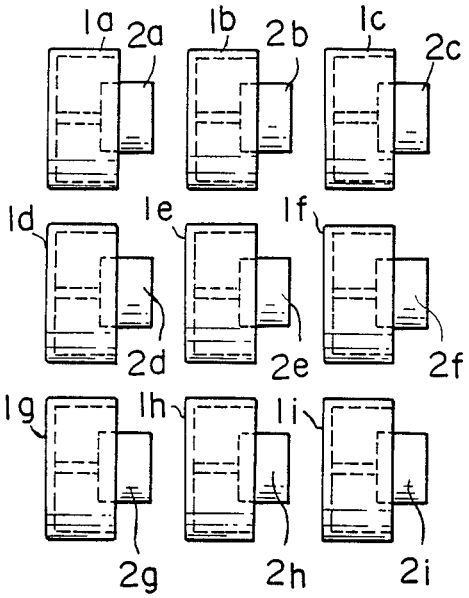
FIG. 1 is a schematic front elevational view showing a first embodiment of a wheel mechanism in accordance with the present invention.

Referring to FIG. 1 in which there is shown a first embodiment of a wheel mechanism in accordance with the present invention, small-diameter wheels 1*a* to 1*i* each have a diameter of, for example, about 50 mm, and the respective wheels 1*a* to 1*i* are provided with motors 2*a* to 2*i* for causing rotation and stoppage of the wheels. The wheels 1*a* to 1*i* and the motors 2*a* to 2*i* respectively correspond to three wheels 1A to 1C and associated motors 2A to 2C which are of a type used in the conventional wheel mechanism shown in FIG. 3.

Figure 3:
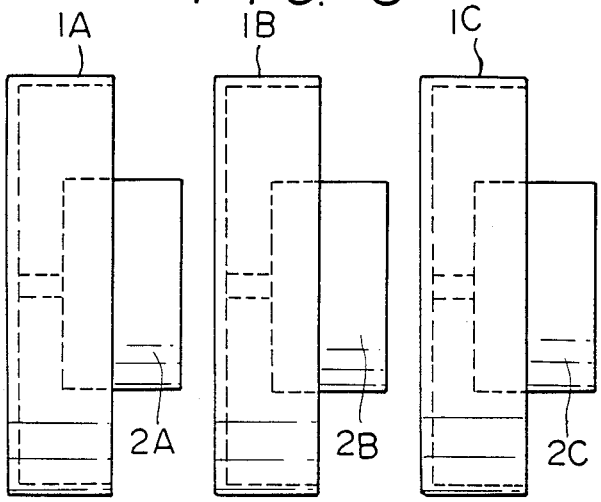
FIG. 3 is a schematic front elevational view showing an example of wheel mechanisms of a conventional type.

The wheels 1A to 1C of the conventional wheel mechanism shown in FIG. 3 each have an outer diameter of about 200 mm, and typically about twenty-one symbols (not shown) for use in a slot machine game are illustrated on each of the wheels 1A to 1C around the outer circumferential surface thereof. The illustrated wheel 1A corresponds to a group of wheels 1*a*, 1*d* and 1*g* of the wheel mechanism shown in FIG. 1 according to the first embodiment of the present invention. Similarly, the wheel 1B of the prior wheel mechanism corresponds to a group of wheels 1*b*, 1*e* and 1*h* of the first embodiment, and the wheel 1C corresponds to a group of wheels 1*c*, 1*f* and 1*i*.

The wheel mechanism according to the first embodiment of the present invention differs from the conventional wheel mechanism in that the wheels 1*a* to 1*i* are individually rotated and stopped by the corresponding motors 2*a* to 2*i*.

In the first embodiment, seven symbols (not shown) are illustrated on the outer circumferential surface of each of the wheels 1*a* to 1*i*, and the symbols on the three wheels 1*a*, 1*d* and 1*g* which are disposed in a vertical line correspond to the symbols on the wheel 1A of the conventional wheel mechanism shown in FIG. 3.

The conventional type of wheel mechanism is arranged in such a manner that, when a single motor associated with each of the wheels is energized and de-energized, an arbitrary symbol on the corresponding wheel appears in one of the windows formed in the face of a slot machine (not shown).

On the other hand, the wheel mechanism according to the first embodiment shown in FIG. 1 is arranged in such a manner that, since the three wheels 1*a*, 1*d* and 1*g* corresponding to the wheel 1A of the conventional wheel mechanism are independently rotated and stopped by the associated motors, a great variety of combinations of symbols can be displayed in the windows formed in the face of the slot machine.

The number of wheels 1*a* to 1*i* is not limited to what is described above, and they may of course be arranged in four or more columns and rows. The diameter of each of the wheels 1*a* to 1*i* is not limited to 50 mm in the first embodiment. Although the diameter may be more or less than 50 mm, it is preferably at least about half the diameter of the conventional type of wheel.

Figure 4:
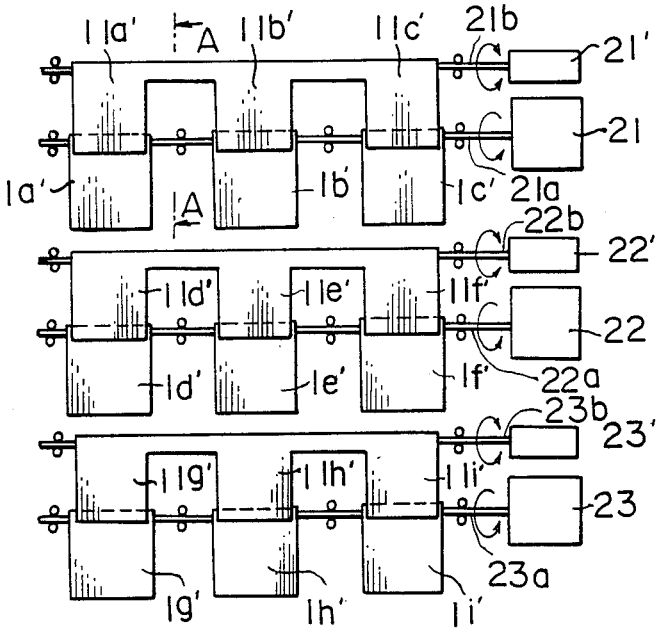
FIG. 4 is a schematic front elevational view showing a second embodiment of a wheel mechanism in accordance with the present invention.
Figure 5:
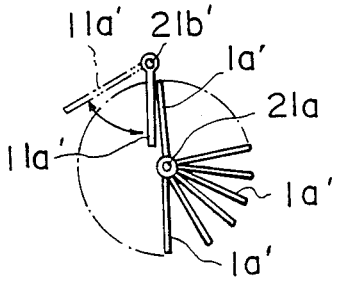
FIG. 5 is a cross section taken along the line A—A of FIG. 4.

FIGS. 4 and 5 show a second embodiment of the present invention. As illustrated, in place of the small diameter wheels 1*a* to 1*i*, a plurality of symbol carrying planar members 1*a*′ to 1*i*′ may be prepared equivalent in number to the desired number of symbols, and the symbol carrying members 1*a*′ to 1*i*′ may be radially attached to motor shafts in groups.

As shown in FIGS. 4 and 5, the proximal ends of horizontal shafts 21*a*, 22*a* and 23*a* are atached to motors 21, 22 and 23, respectively. Flap-shaped symbol carrying plates 1*a*′, 1*b*′ and 1*c*′ are attached to the shaft 21*a* radially about the axis thereof with a certain amount of play allowed for, and a group of seven symbol carrying plates 1*a*′ are mounted on one portion of the shaft 21*a*. Further, the symbol carrying plates 1*b*′ and 1*c*′ which carry the same symbols as the symbol carrying plates 1*a*′ are mounted on the shaft 21*a*, and the symbol carrying plates 1*a*′, 1*b*′ and 1*c*′ are spaced apart at equal intervals in the axial direction.

A shaft 21*b* is disposed parallel to and above the shaft 21*a*, and the proximal end of the shaft 21*b* is provided with an actuator 21′ for causing angular rotation of the shaft 21*b* in the opposite directions. Stopper extensions 11*a*′, 11*b*′ and 11*c*′ are integrally formed and are mounted on the shaft 21*b* at portions thereof which correspond to the symbol carrying plates 1*a*′, 1*b*′ and 1*c*′, respectively. When viewed from one side, the stopper portion 11*a*′ and the symbol carrying plates 1*a*′ assume the positional relationship shown in FIG. 5.

In the second embodiment, the symbol carrying plates 1*a*′ to 1*c*′ and the stopper portions 11*a*′ to 11*c*′ constitute a first set, the symbol carrying plates 1*d*′ to 1*f*′ and the stopper portions 11*d*′ to 11*f*′ constitute a second set, and the symbol carrying plates 1*g*′ to 1*i*′ and the stopper portions 11*g*′ to 11*i*′ constitute a third set. The first, second and third sets are spaced apart vertically and extend horizontally in parallel with one another. In this way, another example of the wheel mechanism in accordance with the present invention can be constructed.

The symbol carrying plates arranged in a horizontal row, that is, for example, the symbol carrying plates 1*a*′ to 1*c*′, correspond to a single wheel 1A used in the conventional wheel mechanism shown in FIG. 3. In other words, each of the symbol carrying plates of the second embodiment corresponds to each of the wheels 1A to 1C when disposed in a horizontal position, and the positional relationship between the symbol carrying plates correspond to the positional relationship between the three horizontal wheels.

It is to be noted that each of the individual symbol carrying plates 1*a*' to 1*i*' may be provided with a motor. If the individual symbol carrying plates 1*a*' to 1*i*' are equipped with independent motors, the same drive system as that of the wheel mechanism shown in FIG. 1 can be adopted.

In operation of the wheel mechanism shown in FIGS. 4 and 5, the stopper portions 11*a*' to 11*i*' are rotated to their upper positions such as those shown, for example, by a dashed line in FIG. 5 by the driving forces of corresponding actuators 21', 22' and 23'. When the shafts 21*a*, 22*a* and 23*a* are respectively rotated by the motion of the motors 21, 22 and 23 in the counterclockwise direction indicated by an arrow in FIG. 5, the symbol carrying plates are rotated about the shafts together and are spun so that they spread out in a radial fashion.

At the same time that the motors 21, 22 and 23 are stopped at proper timings, the corresponding one of the actuators 21', 22' and 23' is started up to cause the associated one of the stopper portions to move to the down position such as that shown, for example, by a solid line in FIG. 5. At this time, the symbol carrying plates are swung vertically from each of the shafts 21*a*, 22*a* and 23*a*, and the symbols on the front ones of the symbol carrying plates correspond to the symbols visible on the conventional wheels when they stop.

Accordingly, the wheel mechanism according to the second embodiment shown in FIGS. 4 and 5 is capable of providing, for example, five prize lines such as 1*a*' - 1*d*' - 1*g*', 1*b*' - 1*e*' - 1*h*', 1*c*' - 1*f*' - 1*i*, 1*a*' - 1*e*' - 1*i*', and 1*c*' - 1*e*' - 1*g*'.

Figure 2:
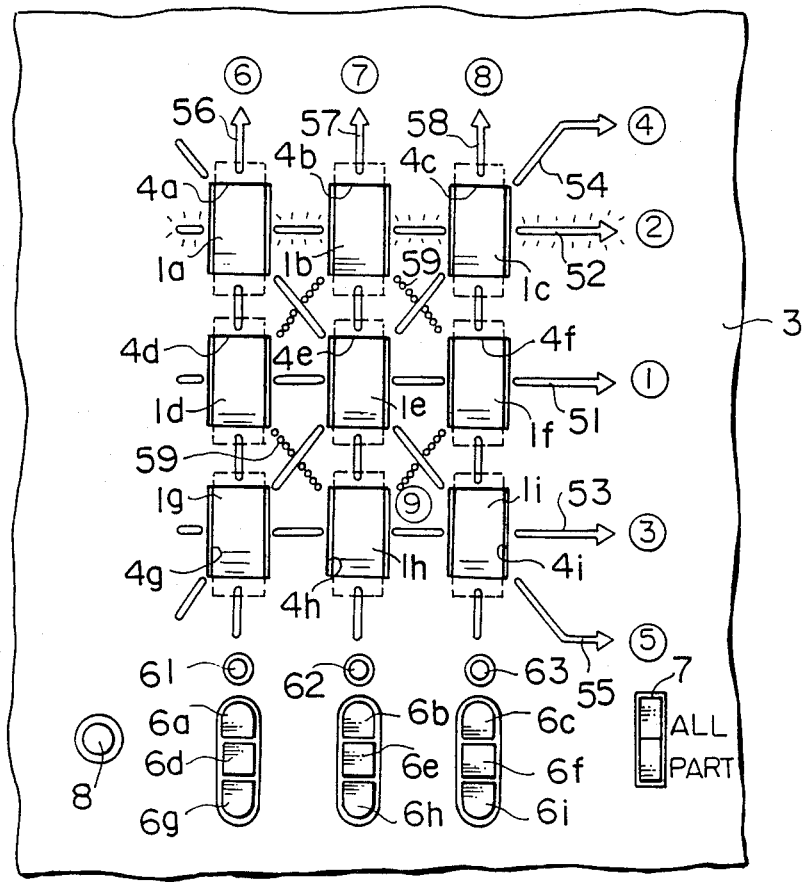
FIG. 2 is a schematic front elevational view showing the essential portion of an example of a slot machine which adopts the first embodiment of the wheel mechanism.

Therefore, if a slot machine is equipped with the first embodiment of the present inventive wheel mechanism shown in FIG. 1 in a manner such as that shown in FIG. 2, prize lines which cannot be realized with a conventional three-wheel type of wheel mechanism can be provided as shown, for example, in FIG. 2.

In FIG. 2, a face panel is indicated generally at 3, and display windows 4*a* to 4*i* are formed in the face panel 3 at positions corresponding to the wheels 1*a* to 1*i* of the present inventive wheel mechanism shown in FIG. 1. Prize lines 51 to 59 are formed around the display windows 4*a* to 4*i*. More specifically, the illustrated prize lines 51 to 59 are formed in such a manner that each of the display windows 4*a* to 4*i* is linked with adjacent ones, vertically, horizontally and diagonally. If a combination of symbols aligned with any of the prize lines 51 to 59 when all the wheels 1*a* to 1*i* stop coincides with a predetermined winning combination of symbols, the player will win a prize corresponding to the predetermined winning combination.

As shown in FIG. 2, linear light emitting elements and dot-like light emitting elements are arranged in lines along the prize lines 51 to 59. The light emitting elements are constituted by elongated lamps or LED devices, linear arrangements of small bulbs, or linear arrangements of rod-like photoconductors and reflection materials. If the prize lines are constituted by photoconductors or the reflection materials, a suitable light source which can flash on and off is disposed at the side of each of them.

The prize lines 51 to 59 respectively link the symbols visible on the wheels which have stopped, and include three horizontal lines (1) to (3) which respectively link the symbols that form horizontal lines in a matrix; three vertical lines (6) to (8) which respectively link the symbols that form vertical lines in the matrix; two orthogonal lines (4) and (5) which respectively link the symbols that form lines in the orthogonal directions in the matrix; and a line (9) which connect the wheels 1*b*, 1*f*, 1*h* and 1*d*. The aforesaid light emitting elements are disposed along or on these nine prize lines.

As shown in FIG. 2, the face panel 3 has independent stop buttons 6*a* to 6*i* which are individually operated to stop the corresponding motors 2*a* to 2*i* associated with the wheels 1*a* to 1*i*, respectively.

In addition to the independent stop buttons 6*a* to 6*i*, this embodiment has general stop buttons 61, 62 and 63 which are disposed in side-by-side relationship and which can be operated to issue stop commands so that predetermined sets of the motors 2*a* to 2*i* are stopped collectively. By way of example, in this embodiment, the general stop buttons 61, 62 and 63 respectively correspond to a first set of motors 2*a*, 2*d* and 2*g*, a second set of motors 2*b*, 2*e* and 2*h*, and a third set of motors 2*c*, 2*f* and 2*i*. Each of the general stop buttons 61, 62 and 63 is arranged to simultaneously issue a stop command to the three motors of the corresponding one of the first to third sets. The combination of motors 2*a* to 2*i* associated with the general stop buttons 61, 62 and 63 is not limited solely to the vertical combination described above. For example, the motors may be combined along the horizontal rows or along diagonal lines.

A selector switch 7 is disposed so that a player can arbitrarily select the general and independent stop buttons in stopping the motors 2*a* to 2*i*.

A start button 8 is disposed so that all the motors 2*a* to 2*i* may be started at the same time.

Figure 6:
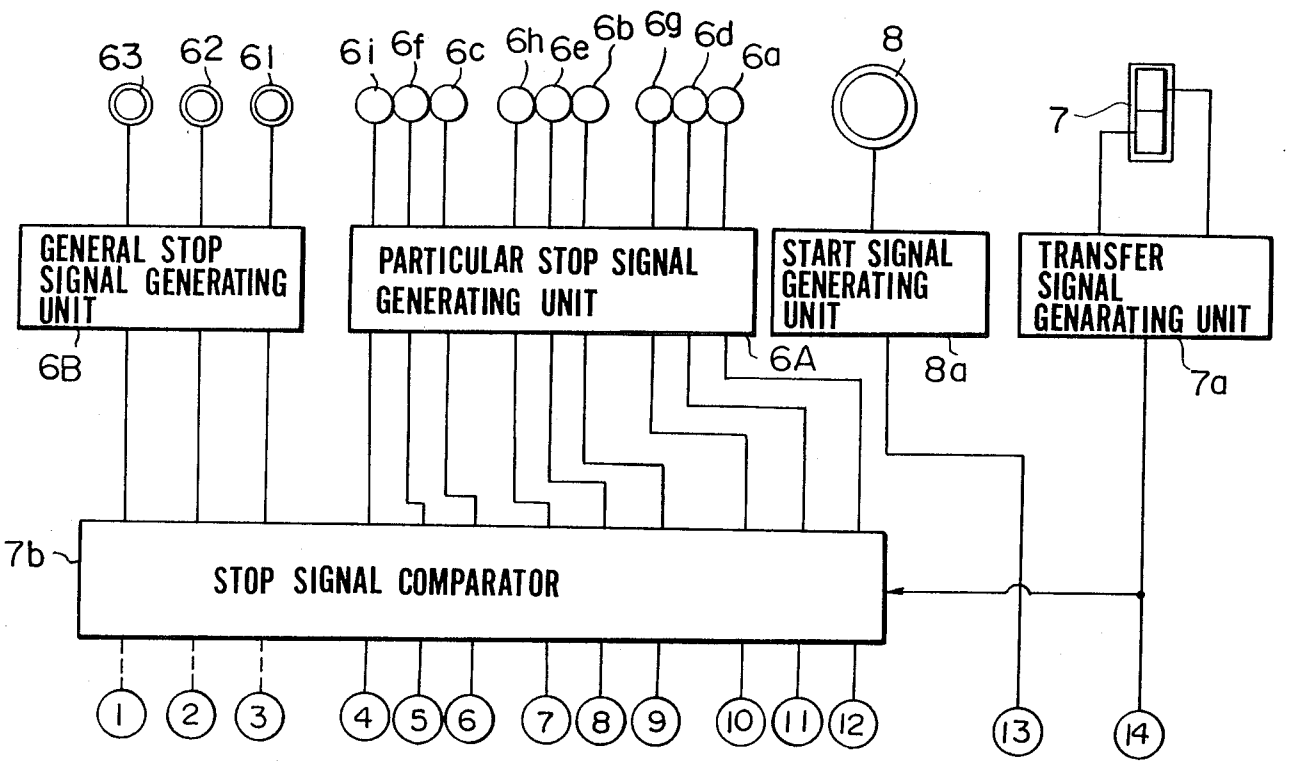
FIG. 6A is the first half of a block diagram of a control/drive circuit for causing start and stop of each motor in the wheel mechanism of the present invention.
FIG. 6B is the second half of a block diagram of a control/drive circuit for causing start and stop of each motor in the wheel mechanism of the present invention.
Figure 6:
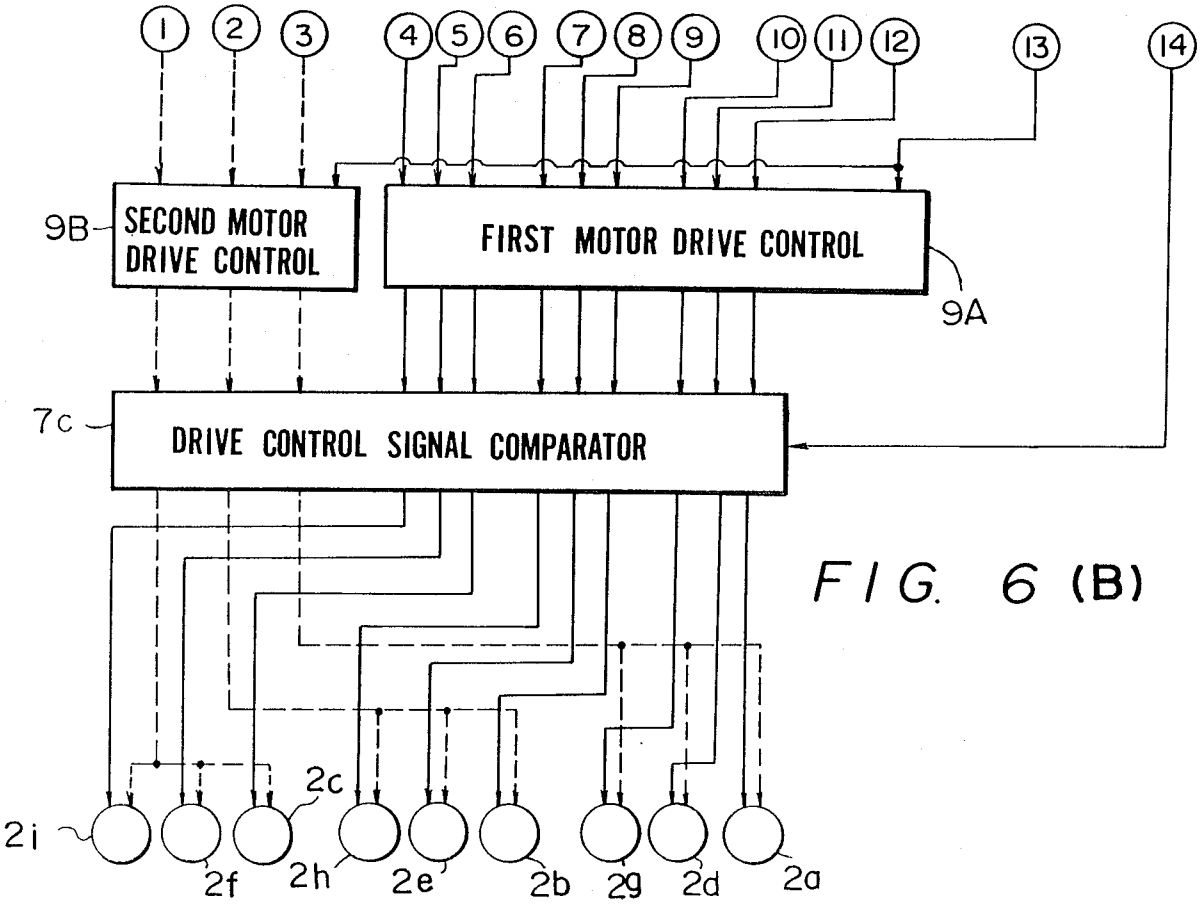

The present inventive wheel mechanism having the above-described functions provides control over the motors 2*a* to 2*i* by means of a control system such as that shown in FIG. 6. The following is a description of the arrangement and operation of the control system.

Referring to FIG. 6 in which like reference numerals are use to denote members like or corresponding to those shown in FIGS. 1 and 2, 7*a* designates a select signal generating unit, 8*a* a start signal generating unit, 6A a stop signal generating unit which is driven in response to the operation of the independent stop buttons 6*a* to 6*i*, and 6B a stop signal generating unit which is driven in response to the operation of the general stop buttons 61, 62 and 63.

A stop signal generating unit 7*b* allows the supply of signals from either the independent stop signal generating unit 6A or the general stop signal generating unit 6B in response to select signals supplied from the select signal generating unit 7*a*.

A first motor controlling circuit 9A responds to signals from the start signal generating unit 8*a* to start up the motors 2*a* to 2*i* at the same time. The first motor controlling circuit 9A responds to signals from the independent stop signal generating unit 6A to supply signals to the motors 2*a* to 2*i* so as to individually stop them.

A second motor controlling circuit 9B responds to signals from the start signal generating unit 8*a* to simultaneously start up, for example, the first set of motors 2*a*, 2*d* and 2*g*, the second set of motors 2*b*, 2*e* and 2*h*, and the third set of motors 2c, 2f and 2i. The second motor controlling circuit 9B responds to signals from the stop signal generating unit 6B to supply signals to the motors 2a to 2i so as to simultaneously stop the motors of each of the first to third sets.

It is to be noted that the three motors which constitute each of these sets can be freely selected from among the motors 2a to 2i in arbitrary combination. The number of motors which constitutes each set can also be freely determined depending upon the number of small diameter wheels employed.

A drive signal selecting unit 7C supplies control drive signals from one of the first and second motor drive circuits 9A and 9B to the respective motors 2a to 2i in response to a select signal from the select signal generating unit 7a.

In operation, when a player wants to operate the slot machine shown in FIG. 2, he starts up the machine by utilizing a predetermined game medium such as a coin, switching the selector switch 7 to its upper or lower position, and depressing the start button 8. Thus, rotation of all the wheels 1a to 1i commences simultaneously, and the game starts.

Subsequently, the player depresses the independent stop buttons 6a to 6i or the general stop buttons 61, 62 and 63 according to the selection at the selector switch 7 to stop the wheels 1a to 1i.

When the wheels 1a to 1i stop rotating, the combinations of the symbols located along the respective prize lines 51 to 59 are automatically detected as electrical signals (this detection can be made by a known detection means). The detected electrical signals are compared with signals representative of predetermined winning combinations of symbols, and judgment is made as to whether or not there is a combination corresponding to any one of the winning combinations. If it is judged that the player has won a prize, game media (e.g., coins) equivalent to the prize are paid out, and one game ends. If the above-described operation is repeated, a plurality of games can be enjoyed successively.

The emission of the light emitting elements which constitute the prize lines 51 to 59 will be described below in conjunction with the functional block diagram shown in FIG. 7, as an example, by reference to the emission of the prize line 52.

Figure 7:
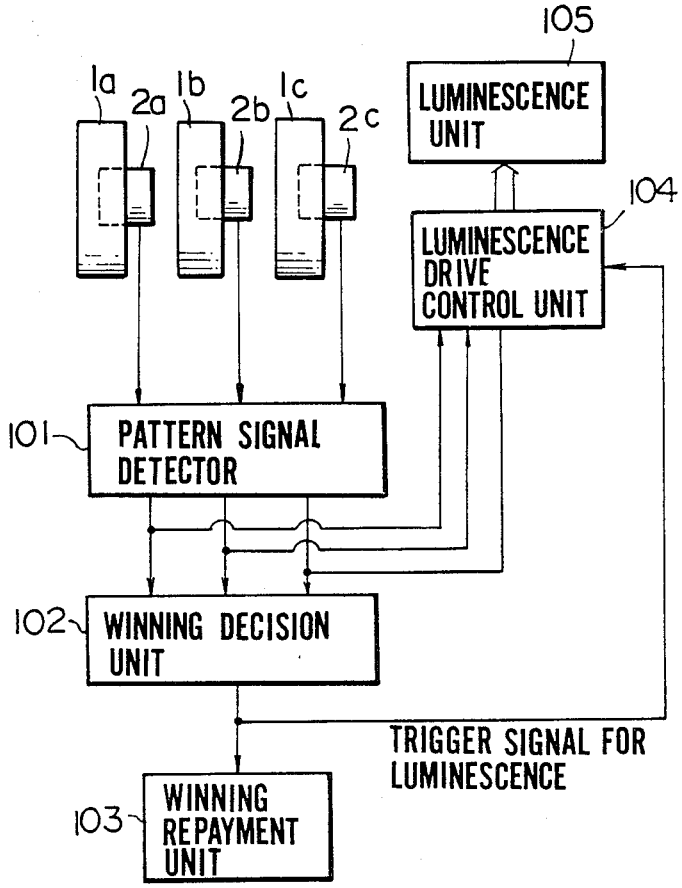
FIG. 7 is a block diagram of one example of a light emitting circuit associated with a prize line in accordance with the present invention.

Referring to FIG. 7, the motors 2a, 2b and 2c are attached to the wheels 1a, 1b and 1c which are located along the prize line 52. A symbol detecting unit 101 detects the symbols which appear in the display windows 4a, 4b and 4c on the prize line 52 when the motors 2a, 2b and 2c have been stopped. A prize judgement unit 102 determines whether or not a signal train representative of the combination of the symbols on the prize line 52 which have been detected by the symbol detecting unit 101 corresponds to any of predetermined trains of winning combinations relative to the prize line 52. If the prize judgement unit 102 judges that the detected signal train represents a winning combination, judgment is made as to the grade of the prize and the number of pay-off medals. In accordance with the judgement, the prize judgement unit 102 outputs a drive/control signal to a payoff unit 103.

In the present wheel mechanism, the output-signal lines of the symbol detecting unit 101 are branched midway, and the outputs of the symbol detecting unit 101 are also supplied to an emission control unit 104 of the light emitting element 105 which constitutes the prize line 52. When an output of the prize judgement unit 102 is supplied to the emission control unit 104, the output triggers the emission of the light emitting element 105 which constitutes the prize line 52 corresponding to the detected signal.

In this example, all the signals of the symbol detecting unit 101 are temporarily supplied to the emission control unit 104. However, unless any winning combination is detected, the emission unit 105 is not driven since no trigger signal is supplied thereto.

It is to be noted that a method of driving the light emitting element 105 is not limited to what is described above, and various modifications and equivalents may be employed.

The present inventive wheel mechanism which is constructed in the above-described manner provides the following merits.

A conventional type of wheel mechanism is commonly constituted by three or more wheels each having a diameter of about 20 cm. However, the wheel mechanism in accordance with the present invention is constituted by wheels which are much smaller in diameter than the wheels of the conventional mechanisms or by symbol carrying members each having a reduced radius of gyration, the wheels or symbol carrying members being arranged in matrix form in correspondence with the conventional arrangement of wheels. Accordingly, although the symbols usable in the present invention are as large as the symbols used in the conventional wheel mechanisms, the depth of a slot machine can be extremely reduced. In accordance with the present invention, even if the number of symbols is the same as the number of symbols used in the conventional wheel mechanism, the number of prize lines can be easily increased. In addition, if the wheel diameter is less than about half the diameter of the conventional wheel diameter, the depth of the casing frame of the slot machine can be reduced to about one half or less. Therefore, even if two slot machines each having the present inventive wheel mechanism are combined in back-to-back relationship, the resultant depth is approximately equal to the depth of a single slot machine of a conventional type, and the space factor of an installation place can be improved by approximately two times that of the conventional type of slot machine.

As described previously in conjunction with the embodiments, the present inventive wheel mechanism is arranged such that, if the selector switch 7 is operated, it is possible to arbitrarily determine whether the wheels 1a to 1i are individually stopped or each set of three wheels, which are arranged side-by-side is stopped in substantially the same manner as the conventional wheel mechanism. In either case, the present inventive wheel mechanism is arranged so that prize lines can be formed, vertically and horizontally as well as diagonally, by arbitrary combinations of the wheels 1a to 1i. Therefore, since at least six prize lines (in the present embodiments, nine prize lines) can be used, the amusement value of a slot machine game is greatly enhanced.

In addition to an increase in the number of prize lines, the wheels serving as symbol carrying means are individually rotated and stopped by the driving of the motors. Therefore, the amusement value of a game is further enhanced.

Moreover, the present inventive wheel mechanism has a winning indicating device which is so arranged that the light emitting elements flash or light along a prize line corresponding to a winning combination. Therefore, the player can immediately obtain information representing what prize line corresponds to the winning combination or what symbols are contained in the winning combination, without the need to observe symbols on the wheels closely. This is very useful in enjoying a game.

What is claimed is:

1. A wheel mechanism for a slot machine, comprising:

(a) an n-by-n spaced apart matrix of relatively small diameter cylindrical bodies, where n is at least three;

(b) n-times-n independently controlled motors, each of said motors being capable of rotating one of said bodies;

(c) a control means operated by a slot machine user for selectively stopping the rotation of said bodies, said control means comprising:

n first stopping devices for simutaneously stopping a line of said bodies in said matrix, n-times-n second stopping devices for stopping each of said bodies individually, whereby a user may determine the number of bodies to be stopped and the order of stopping said bodies.

2. A wheel mechanism for a slot machine, comprising:

(a) an n-by-n spaced apart matrix of rotating plate devices, each said device having plural plates extending radially from an axis, where n is at least three;

(b) plural motors, each of said motors being capable of rotating n of said bodies;

(c) a control means operated by a slot machine user for selectively stopping the rotation of said bodies, said control means comprising:

n actuators, one of said actuators for each row of said matrix of plate devices, n stoppers, each of said stoppers being driven by one of said actuators, said stoppers having n extensions aligned with n of said plate devices in a row of said matrix of plate devices, whereby a user may selectively stop all of said plate devices in a row of said matrix.

3. A wheel mechanism for a slot machine comprising:

a plurality of symbol carrying means, each having a relatively small radius of gyration and carrying a symbol on its visible surface, said symbol carrying means being spaced apart at equal intervals in three horizontal rows and three vertical columns;

a face panel including a display window for each of said symbol carrying means which allows a player to visually confirm symbols on said symbol carrying means, said face panel being disposed in front of said symbol carrying means; and nine prize lines formed on said face panel between said display windows to respectively link said symbols which are visible in said display windows formed in said face panel including one diamond-shaped said prize line, said prize lines not being visible in said display windows.

4. A wheel mechanism for a slot machine comprising:

(a) plural symbol carrying means spaced apart in at least three horizontal rows and at least three vertical columns;

(b) a multiplicity of radially arrayed, symbol-carrying plates extending from each of said symbol carrying means;

(c) plural motors, one for driving said symbol carrying means in each one of said horizontal rows;

(d) plural actuators, one for each of said horizontal rows; and (e) plural stoppers driven by each of said actuators, having plural extensions, one of said extensions for each of said vertical columns, said extensions being aligned with said plates for simultaneously stopping rotation of all said plates in one of said rows when driven by the corresponding one of said actuators.

* * * * *